US005603754A

United States Patent [19]

Aoki et al.

[11] Patent Number: 5,603,754

[45] Date of Patent: Feb. 18, 1997

[54] COMPOSITION AND PROCESS FOR TREATING TINPLATE AND ALUMINUM

[75] Inventors: Tomoyuki Aoki, Chigasaki; Akio Shimizu, Isehara; Masayuki Yoshida, Yokohama, all of Japan

[73] Assignee: Henkel Corporation, Plymouth Meeting, Pa.

[21] Appl. No.: 571,951

[22] PCT Filed: Jul. 5, 1994

[86] PCT No.: PCT/US94/07298

§ 371 Date: Jan. 5, 1996

§ 102(e) Date: Jan. 5, 1996

[87] PCT Pub. No.: WO95/02077

PCT Pub. Date: Jan. 19, 1995

[30] Foreign Application Priority Data

Jul. 5, 1993 [JP] Japan ..... 5-165601

[51] Int. Cl.[6] ..... C09D 5/00; C23C 22/05

[52] U.S. Cl. ..... 106/14.12; 106/14.41; 148/247; 148/253; 148/259; 148/275; 148/277

[58] Field of Search ..... 106/14.12, 14.13, 106/14.14, 14.21, 14.44; 148/247, 253, 259, 275, 277

[56] References Cited

U.S. PATENT DOCUMENTS

| | | | |
|---|---|---|---|
| 4,332,646 | 6/1982 | Tsurumaru et al. | 205/791 |
| 4,992,115 | 2/1991 | Ikeda | 148/247 |
| 4,992,116 | 2/1991 | Hallman | 148/247 |

FOREIGN PATENT DOCUMENTS

| | | | |
|---|---|---|---|
| 3236247 | 4/1984 | Germany | 148/261 |
| 52-131937 | 11/1977 | Japan . | |
| 54-24232 | 2/1979 | Japan | 148/259 |
| 1100281 | 4/1989 | Japan . | |
| 2131052 | 6/1984 | United Kingdom | 148/259 |

*Primary Examiner*—Anthony Green
*Attorney, Agent, or Firm*—Wayne C. Jaeschke; Norvell E. Wisdom, Jr.; Wayne C. Jaeschke, Jr.

[57] ABSTRACT

A bath for the treatment of DI cans that contains phosphate ions, at least one of zirconium and titanium compounds, oxidizing agent at no more than 500 ppm, and fluorides at no more than 2,000 ppm as fluorine, and that has a pH of 2.0 to 4.0, is useful for treating the surface of both aluminum and tinplate cans prior to the painting/printing thereof.

20 Claims, No Drawings

COMPOSITION AND PROCESS FOR TREATING TINPLATE AND ALUMINUM

TECHNICAL FIELD

The invention relates to a novel composition, usually called a "bath" hereinafter for brevity, and process that can be used to treat the surface of both aluminum DI cans and tinplate DI cans and that impart an excellent corrosion resistance and paint adherence to the surface of these cans prior to painting and/or printing them. "Aluminum DI cans" and "tinplate DI cans" refer to cans fabricated by the drawing and ironing, also called draw-ironing, of aluminum sheet and tinplated steel sheet respectively.

BACKGROUND ART

Aluminum DI cans and tinplate DI cans have heretofore been treated with separate special purpose surface treatment baths. Baths for treating the surface of aluminum DI cans are exemplified by the bath taught in Japanese Laid Open [Kokai or Unexamined] Patent Application Number Sho 52-131937 [131,937/1977]. The surface treatment bath taught therein is an acidic aqueous coating solution that has a pH of approximately 1.0 to 4.0 and that contains phosphate, fluoride, and zirconium and/or titanium. Treatment with this conversion treatment bath results in the formation of a highly paint-adherent, highly corrosion-resistant conversion film on the aluminum surface. The main components of this film are phosphate salt and zirconium oxide or titanium oxide.

Baths for treating the surface of tinplate DI cans are exemplified by the bath taught in Japanese Laid Open Patent Application Number Hei 1-100281 [100,281/1989]. This invention comprises a conversion film-forming bath for the treatment of metal surfaces. The bath in this case has a pH of 2 to 6 and contains I to 50 g/L of phosphate ions, 0.2 to 20.0 g/L of oxyacid ions, 0.01 to 5.0 g/L of tin ions, and 0.01 to 5.0 g/L of condensed phosphate ions. Treatment with this conversion treatment bath results in the formation of a highly corrosion-resistant film on the surface of tinplate DI cans. The main component of this film is tin phosphate.

A device known as a washer is generally used to treat the surface of DI cans. The formed DI cans are continuously treated with a degreasing composition and a conversion coating composition while turned upside down. Washers currently in use most often execute the following 6 processes: preliminary degreasing, degreasing, water wash, surface treatment, water wash, and a wash with de-ionized water.

In order to conduct surface treatment using such a washer, it has been necessary to select a surface treatment bath adapted to the type of DI cans to be treated. In other words, a treatment bath in accordance with, for example, the invention in Japanese Laid Open Patent Application Number Sho 52-131937 would be used as the surface treatment bath for aluminum DI cans, while a treatment bath in accordance with, for example, Japanese Laid Open Patent Application Number Hei 1-100281 would be used as the treatment bath for tinplate DI

DISCLOSURE OF THE INVENTION

Problems to Be Solved by the Invention

Accompanying recent increases in the diversity of DI cans fabrication, there has been increasing opportunity to collect aluminum DI cans and tinplate DI cans into respective lots of some size and treat these in a single washer in an alternating sequence. However, a high-quality film with good corrosion resistance is not produced when the treatment bath in accordance with Japanese Laid Open Patent Application Number Sho 52-131937 is also applied to tinplate DI cans. On the other hand, a conversion film is not formed when the treatment bath of Japanese Laid Open Patent Application Number Hei 1-100281 is also applied to aluminum DI cans; this results in a poor corrosion resistance and a poor paint film adherence. As a result, each time the treatment substrate changes, it has been necessary to discard the treatment bath, clean the treatment chamber itself, and install a freshly prepared treatment bath that corresponds to the type of substrate.

In view of the circumstances described above, this invention takes as its object the provision of a multipurpose treatment bath and treatment process wherein a single treatment bath can be used to lay down a highly corrosion-resistant, highly paint-adherent film on the surface of both aluminum DI cans and tinplate DI cans.

SUMMARY OF THE INVENTION

The applicants have discovered that eluted metal ions, i.e., aluminum ions or tin ions, have a negative effect on film formation on the surface of a substrate which is not of the same metal. This is a major reason why a high-quality film is not formed when the conventional treatment baths are also applied to substrate different from the one for which they were designed. The applicants further formulated the following working hypotheses which were useful in solving the problems with the prior art as outlined above.

(1) With the conventional treatment baths, a film based on zirconium oxide or titanium oxide is formed on the surface of aluminum DI cans, while a tin oxide-based film is formed on the surface of tinplate DI cans.

(2) Etching of the metal substrate is necessary in order to form the films noted under (1), and this is most readily achieved by adjustment of the treatment bath pH to 2.0 to 4.0. At a pH below 2.0, film formation is impaired due to an excessive etch, while it becomes difficult to produce a highly corrosion-resistant film at a pH in excess of 4.0. Therefore, the pH should be controlled to 2.0 to 4.0.

(3) Tin ions ($Sn^{2+}$, $Sn^{4+}$) elute from the surface of tinplate DI cans under the conditions noted in item (2). When an aluminum can is then treated, the divalent tin ions that have eluted into the treatment bath tend to be reduced to tin metal at the aluminum surface; this prevents the formation of a high-quality film on the aluminum surface. As a result, an oxidizing agent is preferably added to the treatment bath in order to rapidly oxidize the tin ions in the treatment bath to the tetravalent state and thereby achieve their stable presence in the bath.

(4) Aluminum ions elute from the aluminum surface under the conditions noted in item (2), and these aluminum ions destabilize any zirconium or titanium compounds present in the bath. To counter this, fluoride or hydrofluoric acid preferably is added to the treatment bath in order to stabilize the presence of aluminum in the treatment bath by forming fluoride complexes with the aluminum ions.

(5) While the oxidizing agent accelerates the formation of zirconium oxide or titanium oxide on an aluminum surface, it tends to inhibit the formation of a protective coating including tin phosphate on a tin surface. Since more than 500 parts per million by weight (hereinafter usually abbreviated "ppm") of oxidizing agent will usually prevent film formation, the appropriate upper limit on the oxidizing agent is 500 ppm. Excessive levels of hydrofluoric acid or fluoride result in an excessive etch, which degrades the appearance, and a suitable upper limit on this additive is 2,000 ppm as fluorine.

Accordingly, a composition according to the invention for the treatment of DI cans contains phosphate ion and at least 1 selection from zirconium compounds and titanium compounds and has a pH of 2.0 to 4.0, contains oxidizing agent at no more than 500 ppm and at least 1 selection from simple and complex fluorides and their corresponding acids in a total amount that is no more than 2,000 ppm stoichiometric equivalent as fluorine. More preferably, a composition according to the invention consists essentially of water, the other ingredients noted above, and, if desired, the optional ingredient(s) noted below, and still more preferably consists only of these ingredients plus any necessary counterions to provide electrical neutrality to the composition and possible impurities in the desired ingredients.

Another embodiment of the invention is a process for treating the surface of aluminum DI cans and tinplate DI cans, said process being characterized by contacting the cleaned surface of aluminum DI cans or tinplate DI cans with the treatment bath described above.

DESCRIPTION OF PREFERRED EMBODIMENTS

The oxidizing agent in a composition according to the invention is exemplified by hydrogen peroxide, chlorates, nitrites, tungstates, molybdates, and the like, and thus is not narrowly restricted in scope. However, hydrogen peroxide is preferred. Since the oxidizing agent functions to stabilize the tin ion eluted from the DI cans, its optimal content is a function of the amount of tin elution. An oxidizing agent content in the range of 20 to 500 ppm is preferred for eluted tin concentrations on the level of 50 ppm, while the range of 40 to 200 ppm for the oxidizing agent is particularly preferred under most conditions of operation of a process according to this invention. These numerical values apply specifically to hydrogen peroxide; for other oxidizing agents the values should be adjusted appropriately to provide the same oxidizing power as does the stated amounts of hydrogen peroxide. Ordinarily, the value for other oxidizing agents may be computed with sufficient accuracy for the purposes of the invention by noting the number of electrons involved in the reduction reaction of the particular oxidizing agent used and adjusting the amount of oxidizing agent to provide removal of the same number of electrons from the oxidized substrate as does the specified amounts of hydrogen peroxide. Alternatively, the oxidizing power may be measured by comparing the electrical potential of an inert electrode such as a platinum electrode that is immersed in the composition, and adjusting the amount of other oxidizing agents so that the same electrical potential is produced in the treatment composition according to the invention as with the specified amountsof hydrogen peroxide.

An organic acid that can readily form complexes with dissolved tin ions, aluminum ions, or both, for example, gluconic acid or oxalic acid, may be added on a supplementary basis in the event of a major decline in treatment bath stability due to metal ions, for example, iron or tin ions eluting from tinplate DI cans, aluminum eluting from aluminum DI cans, and the like.

The treatment bath must contain at least 1 selection from simple and complex fluorides and their corresponding acids. The fluoride content preferably is derived from hydrofluoric acid (HF) or a salt thereof such as sodium fluoride (NaF), or through the use of fluozirconic acid ($H_2ZrF_6$) or fluotitanic acid ($H_2TiF_6$) or their salts. The optimal fluoride content is determined as a function of the concentration of aluminum that elutes from the aluminum DI cans. For example, 100 ppm aluminum preferably requires approximately 200 ppm fluorine. The fluoride content preferably falls in the range of 10 to 2,000 ppm as fluorine and more preferably, with increasing preference in the order given, falls in the range of 20 to 900, 40 to 500, 60 to 200, or 90 to 165, ppm as fluorine. When the fluoride content falls below 10 ppm as fluorine, the treatment bath becomes poorly reactive with the surface of aluminum DI cans and an acceptable film is not usually produced.

The other components used in the invention treatment bath correspond to those used in conventional treatment baths. Thus, phosphoric acid ($H_3PO_4$), sodium phosphate ($Na_3PO_4$), and the like can be used to supply the phosphate ion in the treatment bath. Although less preferred, condensed phosphoric acids such as pyrophosphoric acid ($H_4P_2O_7$) and tripolyphosphoric acid ($H_5P_3O_{10}$) and their salts can also be used. While the phosphate ion content is not narrowly restricted, values in the range of 10 to 500 ppm are preferred and values in the range of 20 to 90 ppm are more preferred. In determining these values, the stoichiometric equivalent as phosphate of all phosphoric acid(s) and anions formed by ionization thereof is considered to be phosphate.

The source of the zirconium and titanium compounds for the treatment bath is not narrowly restricted in scope, and the oxides, hydroxides, fluorides, and the like of zirconium and titanium can all be used, as can fluozirconic and fluotitanic acids and their salts, these acids and their salts being preferred. The content of zirconium or titanium compound is preferably 10 to 200 ppm as Zr or Ti and more preferably, with increasing preference in the order given, 10 to 150, 20 to 100, or 25 to 90, ppm as Zr or Ti.

The pH of the treatment bath can be adjusted through the use of an acid such as phosphoric acid, nitric acid, hydrochloric acid, or hydrofluoric acid, or through the use of an alkali such as sodium hydroxide, sodium carbonate, or ammonium hydroxide. The pH of the treatment bath normally should be from 2.0 to 4.0, while the range of 2.5 to 3.3 is preferred.

The technique for contacting the surface treatment bath with aluminum DI cans or tinplate DI cans is exemplified by immersion, spraying, and the like as generally known in the art, with spraying being the preferred technique. The temperature of the treatment bath should usually be 20° to 65° C. and is preferably 25° to 65°, more preferably 30° to 60°, or still more preferably 30° to 35° C. The treatment time usually is from 2 to 120 seconds, preferably from 2 to 60 seconds, and particularly preferably from 15 to 60 seconds. A treatment time below 2 seconds does not usually produce an adequate reaction, thereby essentially precluding the formation of a highly corrosion-resistant film, while the improvement in performance diminishes at treatment times in excess of 60 seconds.

The treatment bath of the present invention is preferably used as part of the following process steps:

(1) cleaning of the DI cans surface, preferably by degreasing;
(2) water wash;
(3) film-formation treatment, using a composition according to the invention;
(4) water wash;
(5) wash with deionized water; and
(6) drying.

EXAMPLES

The usefulness of the surface treatment bath of the present invention is illustrated below through a comparison of several working examples with comparative examples. In these examples and comparison examples, any unspecified material in a treatment bath composition is water.

General Conditions for Examples and Comparison Examples

The aluminum DI cans

The aluminum DI cans were fabricated by the draw-ironing of aluminum sheet. They were cleaned using the hot aqueous solution of an acidic degreaser (Palklin™ 400, from Nihon Parkerizing Company, Ltd., Tokyo) and then subjected to surface treatment.

The tinplate DI cans

The tinplate DI cans were fabricated by the draw-ironing of tin-plated steel sheet. They were cleaned using a hot aqueous solution of a weakly alkaline degreaser (Finecleaner™ 4361A, from Nihon Parkerizing Company, Ltd., Tokyo) and then subjected to surface treatment.

Corrosion resistance

The corrosion resistance of the aluminum DI cans was evaluated by immersing the treated cans in boiling water for 30 minutes and then evaluating the degree of blackening (the absence of blackening is preferred). The corrosion resistance of the tinplate DI cans was evaluated using the iron exposure value ("IEV") measured in accordance with U.S. Pat. No. 4,332,646. A lower IEV is indicative of a better corrosion resistance, and values at or below 150 are generally considered excellent.

Paint adherence

The paint adherence was evaluated on the basis of the peel strength as follows: An epoxy-urea can paint was applied on the surface of the treated can to yield a paint film thickness of 5 to 7 micrometers. After baking for 4 minutes at 215° C., a 5×150 mm strip was cut from the can. A test specimen was prepared by hot-press bonding the strip with polyamide film, and the test specimen was peeled in a 180° peel test to provide the peel strength value. Higher peel strength values are indicative of a better paint adhesion, and values of at least 1.5 kilograms-force ("kgf")/5 mm of width are generally considered excellent.

EXAMPLE 1

Cleaned aluminum DI cans and cleaned tinplate DI cans were subjected to the following sequence of treatments: spraying for 30 seconds with surface treatment bath 1 heated to 40° C., then washing with tap water, spraying with deionized water (having a specific resistance of at least 3 megaohm-cm) for 10 seconds, and finally drying for 3 minutes in a forced convection drying oven at 180° C. The corrosion resistance and adherence of the resulting DI cans were then measured.

| Surface treatment bath 1 | | | |
|---|---|---|---|
| 75% phosphoric acid ($H_3PO_4$): | 69 ppm | ($PO_4^{3-}$: | 50 ppm) |
| 20% fluozirconic acid ($H_2ZrF_6$): | 500 ppm | ($Zr^{4+}$: | 44 ppm) |
| 20% hydrofluoric acid (HF): | 210 ppm | (total $F^{-1}$: | 95 ppm[1]) |
| 30% hydrogen peroxide ($H_2O_2$): | 166 ppm | ($H_2O_2$: | 50 ppm) |
| pH 3.0 (adjusted with aqueous ammonia) | | | |

[1]The total fluoride in this and all the other compositions containing both simple and complex fluoride ions is the total from both sources.

EXAMPLE 2

Cleaned aluminum DI cans and cleaned tinplate DI cans were subjected to the following sequence of treatments: spraying for 15 seconds with surface treatment bath 2 heated to 30° C., then a water wash, wash with de-ionized water, and drying as in Example 1. The corrosion resistance and adherence of the resulting DI cans were subsequently measured.

| Surface treatment bath 2 | | | |
|---|---|---|---|
| 75% phosphoric acid ($H_3PO_4$): | 69 ppm | ($PO_4^{3-}$: | 50 ppm) |
| 20% fluozirconic acid ($H_2ZrF_6$): | 1000 ppm | ($Zr^{4+}$: | 88 ppm) |
| 20% hydrofluoric acid (HF): | 210 ppm | (total $F^-$: | 150 ppm) |
| 30% hydrogen peroxide ($H_2O_2$): | 166 ppm | ($H_2O_2$: | 50 ppm) |
| pH 3.3 (adjusted with aqueous ammonia) | | | |

EXAMPLE 3

Cleaned aluminum DI cans and cleaned tinplate DI cans were subjected to the following sequence of treatments: spraying for 15 seconds with surface treatment bath 3 heated to 35° C., then a water wash, wash with deionized water, and drying as in Example 1. The corrosion resistance and adherence of the resulting DI cans were subsequently measured.

| Surface treatment bath 3 | | | |
|---|---|---|---|
| 75% phosphoric acid ($H_3PO_4$): | 69 ppm | ($PO_4^{3-}$: | 50 ppm) |
| 20% fluotitanic acid ($H_2TiF_6$): | 500 ppm | ($Ti^{4+}$: | 29 ppm) |
| 20% hydrofluoric acid (HF): | 210 ppm | (total $F^-$: | 110 ppm) |
| 30% hydrogen peroxide ($H_2O_2$): | 664 ppm | ($H_2O_2$: | 200 ppm) |
| pH 2.5 (adjusted with aqueous ammonia) | | | |

EXAMPLE 4

Cleaned aluminum DI cans and cleaned tinplate DI cans were subjected to the following sequence of treatments: spraying for 30 seconds with surface treatment bath 4 heated to 40° C., then a water wash, wash with deionized water, and drying as in Example 1. The corrosion resistance and adherence of the resulting DI cans were subsequently measured.

| Surface treatment bath 4 | | | |
|---|---|---|---|
| 75% phosphoric acid ($H_3PO_4$): | 138 ppm | ($PO_4^{3-}$: | 100 ppm) |
| 20% fluotitanic acid ($H_2TiF_6$): | 500 ppm | ($Ti^{4+}$: | 29 ppm) |
| 20% hydrofluoric acid (HF): | 210 ppm | (total $F^-$: | 110 ppm) |
| 30% hydrogen peroxide ($H_2O_2$): | 166 ppm | ($H_2O_2$: | 50 ppm) |
| pH 3.5 (adjusted with aqueous ammonia) | | | |

EXAMPLE 5

As discussed above, a critical issue for multipurpose treatment baths is the film performance when metal ions different from the substrate metal have entered the bath by a preceding elution from DI cans. In this example, 500 ppm of tin ions was introduced into surface treatment bath 1 and the resulting surface treatment bath, heated to 60° C., was used for a 30-second spray treatment. Washing and drying were then carried out as in Example 1.

EXAMPLE 6

100 ppm of aluminum ions were introduced into surface treatment bath 1 and the resulting surface treatment bath, heated to 30° C., was used for a 30-second spray treatment. Washing and drying were then carried out as in Example 1.

EXAMPLE 7

50 ppm of tin ions were introduced into surface treatment bath 2 and the resulting surface treatment bath, heated to 60° C., was used for a 30-second spray treatment. Washing and drying were then carried out as in Example 1.

EXAMPLE 8

100 ppm of aluminum ions were introduced into surface treatment bath 2 and the resulting surface treatment bath, heated to 30° C., was used for a 30-second spray treatment. Washing and drying were then carried out as in Example 1, and the corrosion resistance and adherence of the resulting DI cans were measured.

COMPARATIVE EXAMPLE 1

Cleaned aluminum DI cans and cleaned tinplate DI cans were subjected to the following sequence of treatments: spraying for 30 seconds with surface treatment bath 5 heated to 30° C., then a water wash, wash with deionized water, and drying as in Example 1. The corrosion resistance and adherence of the resulting DI cans were subsequently measured.

| Surface treatment bath 5 | | | |
|---|---|---|---|
| 75% phosphoric acid ($H_3PO_4$): | 69 ppm | ($PO_4^{3-}$: | 50 ppm) |
| 20% fluozirconic acid ($H_2ZrF_6$): | 500 ppm | ($Zr^{4+}$: | 44 ppm) |
| 20% hydrofluoric acid (HF): | 210 ppm | (total $F^-$: | 95 ppm) |
| pH 3.0 (adjusted with aqueous ammonia) | | | |

COMPARATIVE EXAMPLE 2

Cleaned aluminum DI cans and cleaned tinplate DI cans were subjected to the following sequence of treatments: spraying for 30 seconds with surface treatment bath 6 heated to 30° C., then a water wash, wash with deionized water, and drying as in Example 1. The corrosion resistance and adherence of the resulting DI cans were subsequently measured.

| Surface treatment bath 6 | | | |
|---|---|---|---|
| 75% phosphoric acid ($H_3PO_4$): | 69 ppm | ($PO_4^{3-}$: | 50 ppm) |
| 20% hydrofluoric acid (HF): | 210 ppm | ($F^-$: | 40 ppm) |
| pH 3.0 (adjusted with aqueous ammonia) | | | |

COMPARATIVE EXAMPLE 3

50 ppm of tin ions were introduced into surface treatment bath 5 and the resulting surface treatment bath, heated to 30° C., was used for a 30-second spray treatment. Washing and drying were then carried out as in Example 1, and the corrosion resistance and adherence of the resulting DI cans were measured.

COMPARATIVE EXAMPLE 4

Cleaned aluminum DI cans and cleaned tinplate DI cans were subjected to the following sequence of treatments: heating a commercial surface treatment bath intended for application to aluminum DI cans (Alodine™ 404, from Nihon Parkerizing Company, Ltd., Tokyo) to 30° C. and spraying with this for 30 seconds, then a water wash, wash with deionized water, and drying as in Example 1. The corrosion resistance and adherence of the resulting DI cans were subsequently measured.

COMPARATIVE EXAMPLE 5

Cleaned aluminum DI cans and cleaned tinplate DI cans were subjected to the following sequence of treatments: heating a commercial surface treatment bath intended for application to tinplate DI cans (Palfos™ K3482, from Nihon Parkerizing Company, Ltd., Tokyo) to 30° C. and spraying with this for 30 seconds, then a water wash, wash with deionized water, and drying as in Example 1. The corrosion resistance and adherence of the resulting DI cans were subsequently measured.

The results of all the measurements noted above are shown in Table 1 on the following page.

Benefits of the Invention

The treatment bath in accordance with the present invention produces a titanium oxide-containing or zirconium oxide-containing film on the surface of aluminum DI cans and produces a tin oxide-containing film on the surface of tinplate DI cans. This multipurpose applicability to different types of substrates is made possible by the presence in the treatment bath of both an oxidizing agent and hydrofluoric acid and/or fluoride and by the stipulation of specific upper limits for them. A process according to the invention provides cans, prior to painting and/or printing them, with an excellent corrosion resistance and paint adherence through a low-temperature treatment.

TABLE I

| | Corrosion Resistance | | Paint Film Adherence (Kgf/5 mm of Width) | |
|---|---|---|---|---|
| | Aluminum (Blackening) | Tin-plate (IEV) | Alum-inum | Tinplate |
| Example 1 | no blackening | 100 | 5.0 | 3.5 |
| Example 2 | no | 100 | 5.0 | 3.5 |

TABLE I-continued

| | Corrosion Resistance | | Paint Film Adherence (Kgf/5 mm of Width) | |
|---|---|---|---|---|
| | Aluminum (Blackening) | Tin-plate (IEV) | Alum-inum | Tinplate |
| Example 3 | blackening no | 100 | 5.0 | 3.5 |
| Example 4 | blackening no | 100 | 5.0 | 3.5 |
| Example 5 | blackening no | 100 | 5.0 | 3.5 |
| Example 6 | blackening no | 100 | 5.0 | 3.5 |
| Example 7 | blackening no | 100 | 5.0 | 3.5 |
| Example 8 | blackening no | 100 | 5.0 | 3.5 |
| Comparative Example 1 | blackening moderate | 200 | 2.5 | 1.5 |
| Comparative Example 2 | blackening blackening over entire surface | 300 | 1.0 | 1.0 |
| Comparative Example 3 | blackening over entire surface | 180 | 1.0 | 1.0 |
| Comparative Example 4 | no blackening | 300 | 5.0 | 1.0 |
| Comparative Example 5 | blackening over entire surface | 100 | 1.0 | 3.5 |

The invention claimed is:

1. An aqueous liquid composition suitable for treating both aluminum and tinplate surfaces to form a protective coating thereon, said aqueous liquid composition having a pH of 2.0 to 4.0 and consisting essentially of water and:

(A) at least one dissolved zirconium or titanium compound in an amount stoichiometrically equivalent to at least 10 ppm of the total of zirconium and titanium;

(B) an amount of dissolved oxidizing agent that has oxidizing power equivalent to that of a concentration of from 20 to 500 ppm of hydrogen peroxide;

(C) from 10 to 2000 ppm stoichiometric equivalent as $F^-$ of a dissolved component selected from the group consisting of fluorine-containing anions and their corresponding acids; and (D) at least 10 ppm of dissolved phosphate anions; and, optionally, one of more of:

(E) a component of organic acid that can form complex ions with dissolved tin or aluminum ions or both;

(F) dissolved aluminum ions; and (G) dissolved tin ions.

2. An aqueous liquid composition according to claim 1, wherein the concentration of component (A) is from 10 to 200 ppm stoichiometric equivalent as the total of zirconium and titanium, the concentration of component (B) is such as to be equivalent in oxidizing power to from 40 to 200 ppm of hydrogen peroxide, the concentration of component (C) is from 20 to 900 ppm as $F^-$, and the concentration of component (D) is from 10 to 500 ppm as phosphate.

3. An aqueous liquid composition according to claim 2, wherein the concentration of component (A) is from 10 to 150 ppm stoichiometric equivalent as the total of zirconium and titanium, the concentration of component (C) is from 40 to 500 ppm as $F^-$, and the concentration of component (D) is from 20 to 90 ppm as phosphate.

4. An aqueous liquid composition according to claim 3, wherein the concentration of component (A) is from 20 to 100 ppm stoichiometric equivalent as the total of zirconium and titanium and the concentration of component (C) is from 60 to 200 ppm as $F^-$.

5. An aqueous liquid composition according to claim 4, wherein the concentration of component (A) is from 25 To 90 ppm stoichiometric equivalent as the total of zirconium and titanium and the concentration of component (C) is from 90 to 165 ppm as $F^-$.

6. An aqueous liquid composition according to claim 5, wherein component (A) is selected from the group consisting of fluozirconic and fluotitanic acids and salts thereof and the pH is from 2.5 to 3.3.

7. A process of treating tinplate or aluminum cans by contacting surfaces of the cans with a composition according to claim 6.

8. A process, according to claim 7, where the cans are contacted for a time of about 2 to about 120 seconds.

9. A process of treating tinplate or aluminum cans by contacting surfaces of the cans with a composition according to claim 6.

10. A process according to claim 9, where the cans are contacted for a time of about 2 to about 120 seconds and the aqueous liquid composition is maintained at a temperature between about 20° and about 65° C. during contacting.

11. An aqueous liquid composition according to claim 4, wherein component (A) is selected from the group consisting of fluozirconic and fluotitanic acids and salts thereof and the pH is from 2.5 to 3.3.

12. An aqueous liquid composition according to claim 3, wherein component (A) is selected from the group consisting of fluozirconic and fluotitanic acids and salts thereof and the pH is from 2.5 to 3.3.

13. An aqueous liquid composition according to claim 2, wherein component (A) is selected from the group consisting of fluozirconic and fluotitanic acids and salts thereof and the pH is from 2.5 to 3.3.

14. An aqueous liquid composition according to claim 1, wherein component (A) is selected from the group consisting of fluozirconic and fluotitanic acids and salts thereof and the pH is from 2.5 to 3.3.

15. A process of treating tinplate or aluminum cans by contacting surfaces of the cans with a composition according to claim 11.

16. A process according to claim 15, where the cans are contacted for a time of about 2 to about 120 seconds and the aqueous liquid composition is maintained at a temperature between about 20° and about 65° C. during contacting.

17. A process of treating tinplate or aluminum cans by contacting surfaces of the cans with a composition according to claim 14.

18. A process according to claim 17, where the cans are contacted for a time of about 2 to about 120 seconds and the aqueous liquid composition is maintained at a temperature between about 20° and about 65° C. during contacting.

19. A process of treating tinplate or aluminum cans by contacting surfaces of the cans with a composition according to claim 1.

20. A process according to claim 19, where the cans are contacted for a time of about 2 to about 120 seconds and the aqueous liquid composition is maintained at a temperature between about 20° and about 65° C. during contacting.

* * * * *